US005831506A

United States Patent [19]

Crepel

[11] Patent Number: 5,831,506

[45] Date of Patent: Nov. 3, 1998

[54] STATIONARY INDUCTION COIL FOR A SOLENOIDAL INDUCTION LAUNCHER, AND A SOLENOIDAL INDUCTION LAUNCHER PROVIDED WITH SUCH A COIL

[75] Inventor: Bruno Crepel, Belfort, France

[73] Assignee: GEC Alsthom Electromecanique SA, Paris, France

[21] Appl. No.: 631,225

[22] Filed: Apr. 12, 1996

[30] Foreign Application Priority Data

Apr. 14, 1995 [FR] France ..... 95 04531

[51] Int. Cl.[6] ..... H01F 27/29; H01F 27/30; H01F 27/28

[52] U.S. Cl. ..... 336/187; 336/192; 336/198; 336/208

[58] Field of Search ..... 336/62, 195, 187, 336/186, 223, 232, 192, 180, 198, 208; 310/180, 184, 14

[56] References Cited

U.S. PATENT DOCUMENTS

| | | | |
|---|---|---|---|
| 3,702,453 | 11/1972 | Luton | 336/62 |
| 3,958,201 | 5/1976 | Henderson | 336/70 |
| 4,295,071 | 10/1981 | Kaspar | 310/213 |
| 4,761,628 | 8/1988 | Nishi et al. | 336/180 |
| 4,814,735 | 3/1989 | Williamson | 336/192 |

FOREIGN PATENT DOCUMENTS

| | | |
|---|---|---|
| 687 152 | 12/1939 | Germany . |
| 279967 | 11/1927 | United Kingdom . |

*Primary Examiner*—Michael L. Gellner
*Assistant Examiner*—Anh Mai
*Attorney, Agent, or Firm*—Sughrue, Mion, Zinn, Macpeak & Seas, PLLC

[57] ABSTRACT

The invention relates to a coil comprising a hollow former on which a plurality of same-length conductors are wound, together with connection means between the conductors and an electrical power supply for the coil, according to the invention the conductors are insulated, mutually parallel, and angularly offset, being wound together no said former so that each conductor forms spiral turns that are stacked on and interposed between the spiral turns of the other conductors, said conductors forming first and second windings about a common winding axis, one of the free ends of each conductor being accessible on the outer periphery of the first winding while the other free end of the conductor is accessible on the outer periphery of the second winding.

17 Claims, 3 Drawing Sheets

1
2a
2b
3
5a
5b
6
8
10
11
12
12,4a
12,4b
13
14
I
II

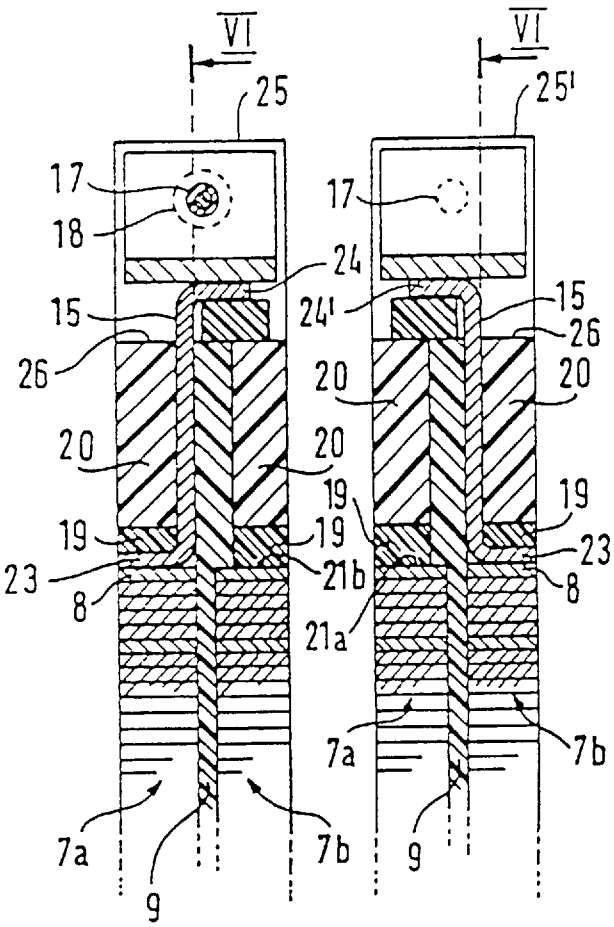
FIG.7B
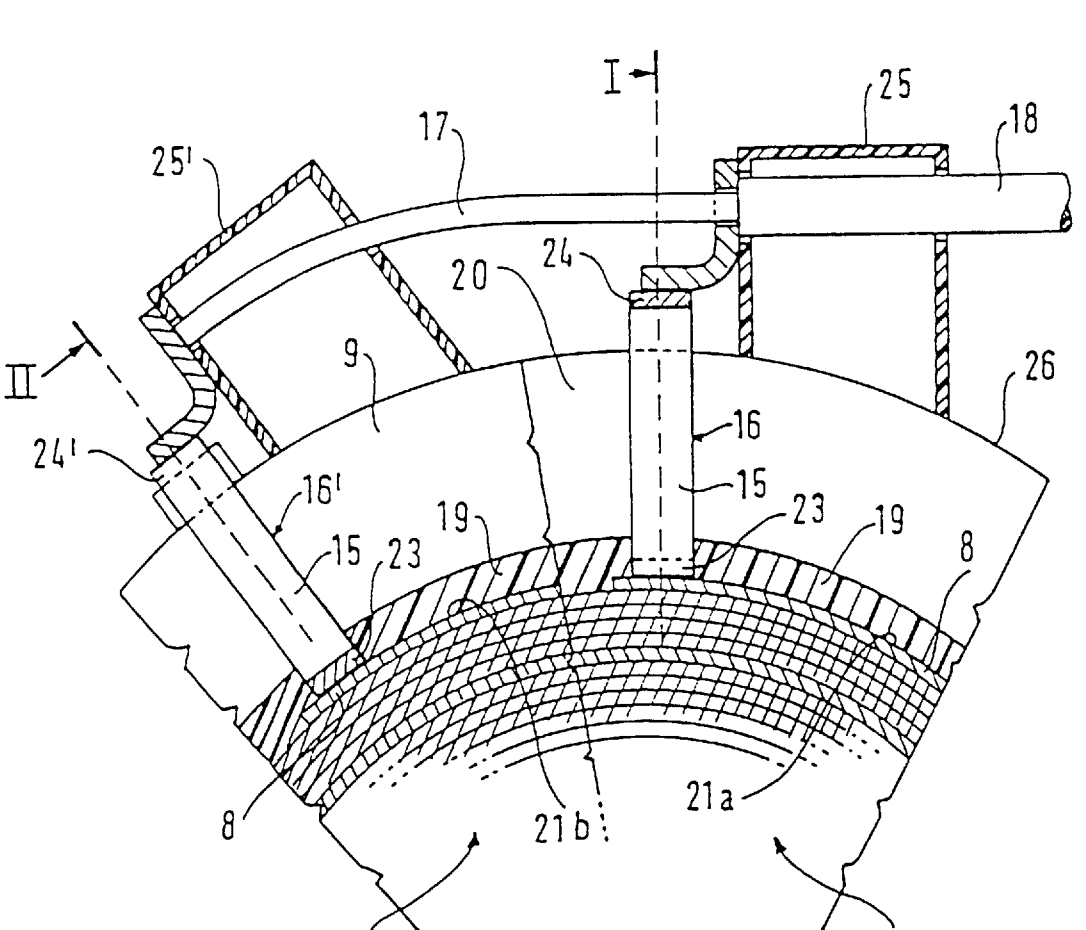
FIG.7A
FIG.6

STATIONARY INDUCTION COIL FOR A SOLENOIDAL INDUCTION LAUNCHER, AND A SOLENOIDAL INDUCTION LAUNCHER PROVIDED WITH SUCH A COIL

The invention relates to a stationary induction coil for a solenoidal induction launcher, and to a solenoidal induction launcher provided with such a coil.

BACKGROUND OF THE INVENTION

The purpose of an induction launcher is to propel a load by using propulsion energy obtained by magnetic induction.

The barrel of the launcher is constituted by a plurality of stationary coils in axial alignment creating a radial magnetic field $\vec{B}$, and the payload to be propelled is placed in the barrel and is attached to a solenoid which is coaxial with the stationary coils, which conveys a current i, and which is immersed in the radial magnetic field $\vec{B}$. Thus, an element of length $d\vec{l}$ of the solenoid is subjected to an axial magnetic propulsion force $d\vec{F}$ given by the equation:

$$d\vec{F}=i d\vec{l}\wedge\vec{B}$$

Such launchers must be capable of launching loads weighing several kilos at high speeds of the order of several thousands of meters per second. This means that the energy required for launching purposes, assuming an average efficiency of 40%, can be as great as several tens of megajoules per meter of barrel for a barrel that is about ten meters long.

The stationary coils of the launcher are therefore dimensioned so as to be capable of delivering such energy. There are numerous problems associated with making such coils. There are problems associated with electrical insulation, problems associated with power supply voltage, problems associated with coil dimensions, problems associated with the electromagnetic forces that develop within the coil, and problems associated with tracking the propelling signal. In addition, all of these problems are interconnected.

OBJECTS AND SUMMARY OF THE INVENTION

An object of the present invention is to provide a coil that solves the above-mentioned problems as well as possible, i.e. a coil that is compact, strong, and that requires limited operating voltage.

Another object of the present invention is to provide such a coil for the purpose of constituting at least one of the stationary induction coils in a solenoidal induction launcher, said coil enabling the propulsion signal to be tracked properly along the barrel.

Another object of the present invention is to propose a solenoidal induction launcher provided with such coils.

To this end, the invention relates to a coil comprising a hollow former on which a coil is made comprising a plurality of conductors of the same length, together with connection means between the conductors and an electrical power supply for the coil. According to the invention, the conductors are insulated, mutually parallel, and wound together on said former, each conductor being angularly offset relative to the other conductors, and forming spiral turns that are stacked and interleaved with the spiral turns of the other conductors, said conductors forming first and second windings on a common winding axis, one of the free ends of each conductor being accessible at the outer periphery of the first winding, while the other free end of the same conductor is accessible on the outer periphery of the second winding.

For each conductor, the crossover between the two windings is located on the former.

In an embodiment of the invention, the conductors are generally rectangular in cross-section.

The former is a circular hollow cylinder, comprising two same-axis and same-diameter integral touching rings, each ring being designed to support one of the two windings, each ring having an outer face provided with the same number of peripheral ramps as there are conductors so as to enable the conductors in the same winding to be offset and superposed, the peripheral ramps of one ring all pointing in one direction of rotation about the axis of the former and the peripheral ramps of the other ring all pointing in the opposite direction of rotation about the axis of the former, each peripheral ramp of one ring pointing in one direction being substantially adjacent to a peripheral ramp of the other ring pointed in the opposite direction, a groove being formed between the tops of the substantially adjacent opposing peripheral ramps so as to allow a conductor to cross over from one winding to the other winding.

In an embodiment of the invention, the ramps are distributed at equal distances over the outer faces, each ramp having a high face concentric with the outer face of the ring, and a slope to pass from the outer face to the high face, each ramp of a given ring being separated from the next by a length of the outer face.

The former also has intermediate elements located at the intersection between the two rings and subdividing each length of the outer face of a ring from the facing length of the outer face of the other ring, said intermediate elements being of a height equal to the height of the high faces of the ramps, and having at least one substantially curvilinear radial wall.

The former may be machined from an insulating material that has high dielectric strength.

The depth of the grooves is substantially equal to the thickness of the conductors, and the width of the grooves is substantially equal to the width of the conductors.

The coil of the invention also includes a winding-separating radial annular wall centered on the axis of the former and located between the first and second windings, said wall having an inside radius that is substantially equal to the radius of the high faces of the ramps.

A winding-separating radial annular wall is disposed concentrically with and in contact with intermediate elements.

The connection means between the conductors and the power supply of the coil are disposed radially on the outer periphery of the coil, each including an electrical connection between a respective end of the conductor and the power supply of the coil.

Each connection comprises a piece of metal foil connected to each end of each conductor of each winding, said pieces of metal foil each having a conductor connection end, a radial portion, and a free end connected to a connection box enabling the metal foil to be connected to a power supply cable, itself connected to the power supply of the coil, the power supply cable reaching the coil tangentially.

An electrically insulating band may be formed on each winding surrounding the conductor connection ends of the pieces of metal foil.

Each winding may be surrounded by an electrically insulating collar, the radial annular insulating wall extending from the outer periphery of the collars and having radial grooves for receiving the radial portions of the pieces of metal foil.

The radial annular insulating wall between the outer periphery of the windings and the outer periphery of the insulating collars presents greater thickness within which said radial grooves for receiving the radial portions of the pieces of metal foil are formed.

For each conductor, the two power supply cables are coaxial, and the two connection boxes are disposed one behind the other, with the free ends of the pieces of metal foil mounted on one of the free ends of the conductor being connected to a first connection box connected to the outer power supply cable of a coaxial cable, and with the inner cable passing through said first connection box in electrically insulated manner, the free end of the piece of metal foil mounted on the other free end of the conductor being connected to a second connection box disposed ahead of the first box and connected to the inner power supply cable of the coaxial cable.

The coil includes two axial end insulating plates.

The invention also provides a coil as described above and constituted by one of the stationary induction coils of a launcher having solenoidal induction.

Finally, the invention also provides a solenoidal induction launcher comprising a plurality of stationary coils in alignment forming a barrel. According to the invention, at least one of the stationary induction coils is a coil as defined above.

A first advantage of the present invention is the possibility, for given coil energy, to reduce the number of coil turns and thus reduce the operating voltage. It is known that the operating voltage is an increasing function of coil inductance, and inductance varies with the square of the number of turns.

Another advantage of the present invention results from the possibility of making coils that are of short axial length. This makes it possible to have more coils per meter of barrel, and thereby to provide better control of the load-propelling signal. These advantages result in particular from the special shape of the former which makes it possible to hold the conductors in place in positions where the electromagnetic reaction forces are greatest, to avoid having bonds between two windings in the vicinity of a zone of great heating due to the eddy currents in the coil, and to have two windings of the transposed type, enabling current to be distributed in balanced manner in each conductor.

BRIEF DESCRIPTION OF THE DRAWINGS

Other advantages and characteristics of the present invention appear from the following description given with reference to the accompanying drawings, in which:

FIG. 6 is a diagrammatic section view showing the links between a conductor and the power supply cables for a coil of the invention; and FIGS. 7A and 7B are diagrammatic section views respectively on lines A and B in the view of FIG. 6.

MORE DETAILED DESCRIPTION

The invention relates to a coil comprising a hollow former 1 on which the coil is wound.

Figure 1:
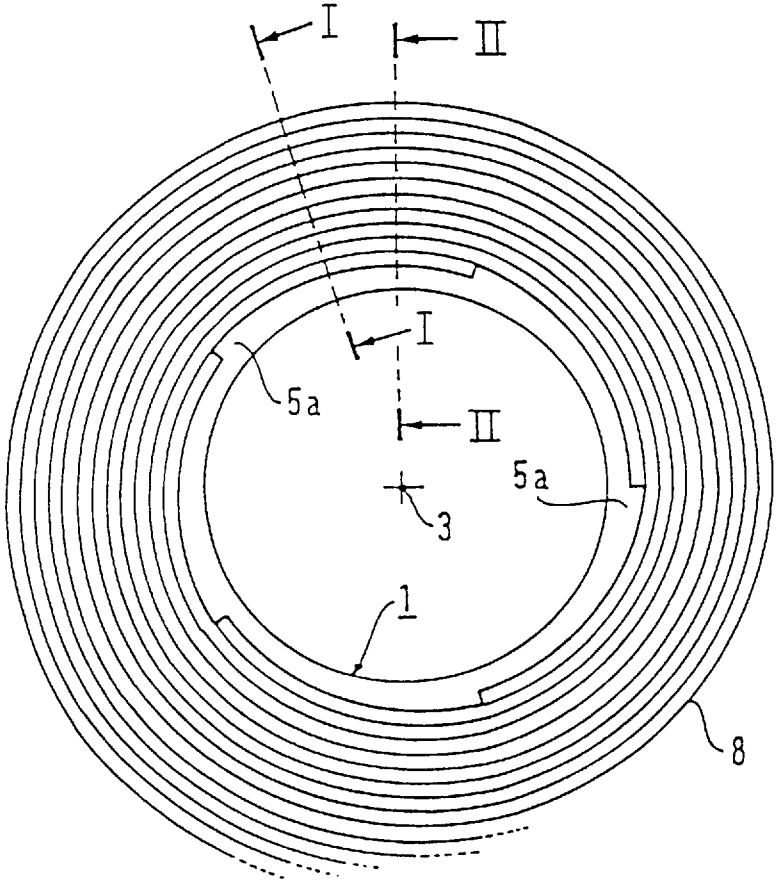
FIG. 1 is a fragmentary diagrammatic end view of a coil of the invention.

The coil comprises a plurality of same-length conductors 8 that are insulated, parallel, and offset, and that are wound together around said former 1. Thus, each conductor 8 forms spiral turns that are interleaved with the spiral turns of other conductors (FIGS. 1, 2A, and 2B).

This method of proceeding makes it possible to obtain a "transposed" coil in which overall current is distributed in balanced manner amongst all of the conductors 8.

The conductors 8 form first and second windings 7*a* and 7*b* having a common winding axis 3, but wound in opposite directions, such that one of the three ends of each conductor 8 is accessible via the outer periphery 21*a* of the first winding 7*a* while the other end of the conductor 8 is accessible on the outer periphery 21*b* of the second winding 7*b* (FIGS. 6, 7A, and 7B).

Figure 2B:
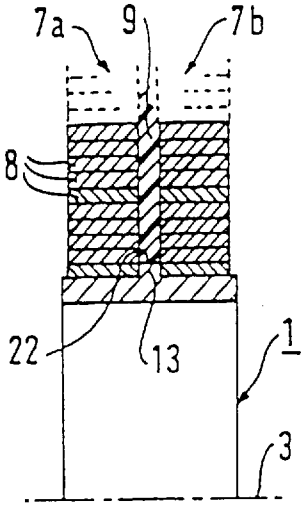
FIGS. 2A and 2B are diagrammatic section views respectively on lines A and B in the view of FIG. 1.
Figure 2A:
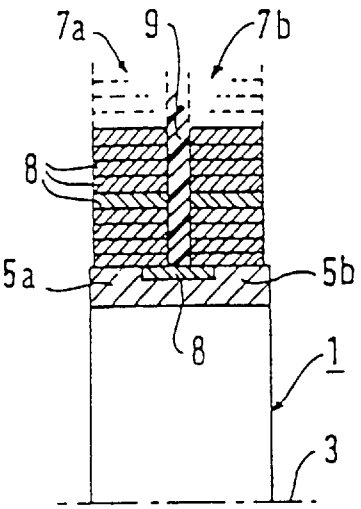

Each conductor 8 constitutes a portion of the first winding 7*a* and a portion of the second winding 7*b* (FIGS. 2A, 2B).

For each conductor 8, the crossover (or passage) between the windings 7*a* and 7*b* is located on the former 1 (FIG. 2A).

In the embodiment shown in the figures, the conductors 8 are rectangular in cross-section.

The former 1 is a circular hollow cylinder (FIG. 3) having two integral adjacent rings 2*a* and 2*b* of the same diameter about the same winding axis 3, with each ring 2*a*, 2*b* being designed to support one of the windings 7*a*, 7*b*. Each ring 2*a*, 2*b* has a respective outside face provided with at least as many peripheral ramps 5*a*, 5*b* as there are conductors 8, for the purpose of offsetting and superposing the conductors 8.

The peripheral ramps 5*a* of one ring 2*a* all point in the same direction of rotation about the winding axis 3 while the peripheral ramps 5*b* of the other ring 2*b* all point in the opposite direction of rotation about the winding axis 3.

Each peripheral ramp 5*a* of a ring 2*a* that points in one direction is substantially adjacent to a peripheral ramp 4*b* of the other ring 2*b* that points in the opposite direction.

A groove 6 is formed between the tops of the substantially adjacent peripheral ramps 5*a* and 5*b* that point in opposite directions. It is within such grooves 6 that the conductors 8 pass from one winding 7*a* to the other winding 7*b*. The width of the grooves 6 is substantially equal to the width of the conductors 8, and the depth thereof is substantially equal to the thickness of the conductors 8.

Thus, a conductor 8 is held in a groove 6 which prevents the conductor 8 from moving under the effect of electromotive reaction forces.

In addition, by bending the conductor (FIG. 5), it is possible to have a conductor 8 that is continuous in both windings 7*a* and 7*b*.

This is an advantage because of the way in which the two windings 7*a* and 7*b* are disposed which gives rise to a danger of considerable heating because of proximity to the former 1 (eddy currents).

A continuous element withstands heating better than do two elements that are bonded together.

In a variant embodiment (FIG. 5) the conductor 8 is a bent one-piece tape shaped to fit in the winding-changing groove 6.

The conductor comprises a plurality of conductor strands. Advantageously, the conductor strands may be transposed.

In a variant embodiment (not shown), the conductor may be cut out as a single piece from a conductive metal sheet and may comprise two parallel and offset tapes that are interconnected by an oblique intermediate portion matching the appearance of the groove 6. This avoids mechanical stresses associated with bending the conductor.

Figures 3, 4A, 4B, 5:
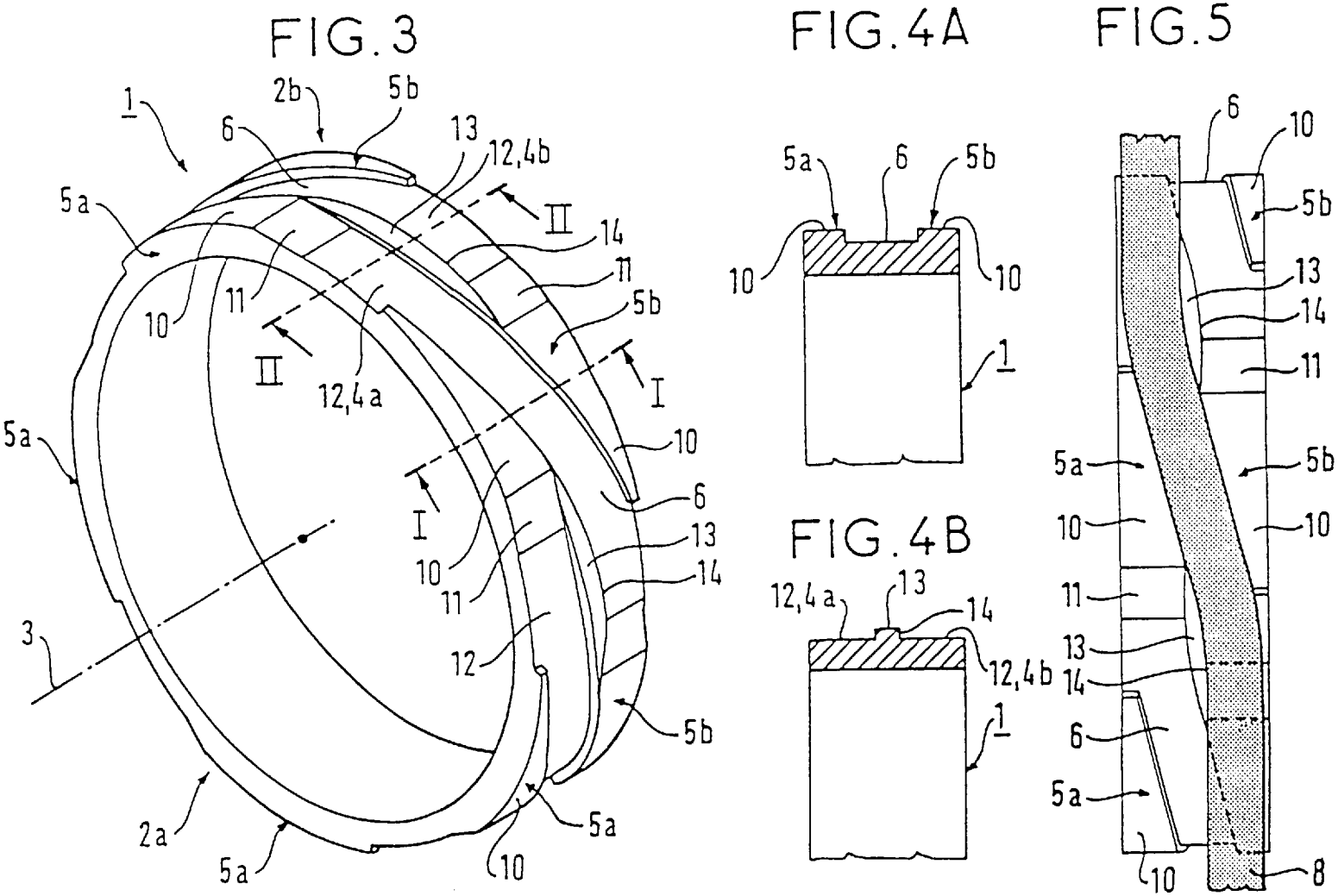
FIG. 3 is a diagrammatic three-quarter view of a former for a coil of the invention.
FIGS. 4A and 4B are diagrammatic section views respectively on lines A and B of FIG. 3.
FIG. 5 is a diagrammatic view showing how a conductor passes between the two windings of a coil of the invention.

In the embodiment shown in FIG. 3, the ramps 5*a* and 5*b* are distributed over equal lengths around the rings 2*a* and 2*b*.

Each ramp 5*a* and 5*b* comprises a top face 10 concentric with the outside face 4*a* or 4*b* of the ring 2*a* or 2*b*, and a slope 11 for passing from the outside face 4*a*, 4*b* to the high face 10.

Each ramp 5*a* and 5*b* on the same ring 2*a*, 2*b* is separated from the following ramp by a length 12 of outside face 4*a*, 4*b*.

The former 1 shown in FIG. 3 also has an intermediate element 13 located at the intersection of two rings 2*a*, 2*b* and separating each length 12 of the outside face 4*a*, 4*b* of one ring 2*a*, 2*b* from the length 12 of the outside face 4*b*, 4*a* of the facing other ring 2*b*, 2*a*. The height of this intermediate element 13 is the same as that of the ramps, and it advantageously has at least one radial wall 14 that is substantially curvilinear for the purpose of bending the conductor 8.

The former 1 is made of an insulating material having high dielectric strength. The former 1 is advantageously made by machining a cylinder having a radius that is not less than the radius of the high faces 10 of the ramps.

In addition, the coil has a radial annular insulating wall 9 for winding separation purposes and centered on the winding axis 3, which wall is located between the first and second windings 7*a*, 7*b* and has an inside diameter substantially equal to the diameter of the high faces 10 of the ramps 5*a*, 5*b*.

Thus, the radial annular insulating wall 9 cooperates with the grooves 6 to form openings through which the conductors 8 from one of the windings 7*a*, 7*b* pass towards the other winding 7*b*, 7*a* (FIG. 2A).

In the embodiment shown in FIG. 2B, the inside periphery 22 of the radial annular insulating wall 9 is in contact with the intermediate elements 13.

The coil of the invention includes radial connection means for powering the coil.

The radial connection means are situated on the outer periphery of the coil (FIGS. 6, 7A, 7B).

These connection means comprise a link between each free end of a conductor 8 and the power supply of the coil.

In a non-limiting embodiment of the invention, each link comprises a piece of metal foil 16 connected to each free end of each conductor 8. That is to say that each conductor has two pieces of metal foil 16 and 16' mounted thereto, comprising a piece of foil 16' on the free end of the conductor that is accessible on the outer periphery 21*a* of the first winding 7*a*, and a second piece of metal foil 16 that is on the free end of the conductor accessible on the outer periphery 21*b* of the second winding 7*b*.

Each piece of foil comprises one end 23 for connection to a conductor, a radial portion 15, and a free end 24 connected to a connection box 25 enabling the metal foil 16 to be connected with a power supply cable 17, 18 itself connected to a power supply for the conductor, the power supply cable 17, 18 meeting the coil tangentially.

Advantageously, and to improve the mechanical strength and the insulation of the coil, each winding has an electrically insulating band 19 placed thereabout and covering the connection ends 23 between the conductor and the pieces of metal foil 16.

Each winding may also be surrounded by a collar 20 of insulating material, with the radial annular insulating wall 9 extending to the outer periphery of the collars 20, and having radial grooves for receiving the radial portions 15 of the pieces of metal foil 16.

To this end, the radial annular insulating wall 9 may present, between the outer periphery 21*a*, 21*b* of the windings 7*a*, 7*b* and the outer periphery 26 of the collars 20, a portion of excess thickness in which said radial grooves are shaped for the radial portions 15 of the pieces of metal foil 16.

For each conductor 8, the two power supply cables 17 and 18 are coaxial, and the two connection boxes 25 follow each other.

The free end 24 of one of the pieces of metal foil 16 extending to one of the free ends of the conductor 8 is connected to the first connection box 25 and is also connected to the outer power supply cable 18 of said coaxial cables, while the inner cable 17 passes in electrically insulating manner through said first connection box 25.

The free end 24' of the piece of metal foil 16' connected to the other free end of the connector 8 is connected to a second connection box 25' disposed in front of the box 25 and connected to the inner power supply cable 17 of the coaxial cables. To this end, the pieces of metal foil are generally Z-shaped.

Advantageously, protective insulating axial end plates (not shown) are mounted on the axial ends of the coil.

A method of manufacturing the coil of the invention is described below.

Once the former has been made, the middle portions of the conductors are placed in the crossover grooves;

one of the windings is made by forming corresponding half-bends;

the annular insulating wall 9 is put into place and then the second winding is made by finishing off the bends;

the pieces of metal foil are installed on the free ends of the conductors, e.g. by soldering;

banding is performed;

the insulating collars are installed;

the connection boxes are mounted on the insulating collars;

the two insulating annular end walls are put into place; and the pieces of metal foil are connected to the connection boxes.

The invention also provides a coil as described above and forming a portion of the stationary induction coils that make up the barrel of a solenoidal induction launcher. Advantageously, the axial end face may include elements enabling a coil to be coupled and positioned relative to the preceding coil and relative to the following coil.

The invention also relates to a solenoidal induction launcher comprising a barrel made up of a plurality of stationary induction coils, with at least one of the stationary coils being of the above-described type.

A numerically worked example is described below. This example is not limiting and serves merely to complement the general description given above.

To launch a mass of 4 kg at a velocity of 2500 m/s requires 12.5 MJ of energy. Given efficiency of 40%, it is therefore necessary to provide about 30 MJ to the coils of the launcher, which for a barrel of length equal to about 7 m, means an energy density per unit length of 4.55 MJ/m.

Some of the coils, at the beginning of the barrel, were made using five conductors each forming twice three turns. In addition, the axial length of the coils was set at 40 mm, i.e. one-tenth of the wavelength of the propulsion signal in order to provide good signal tracking (ten coils per wavelength). The outside diameter of each coil was about 440 mm, and the inside diameter of the coil or the former was about 130 mm, the thickness of the conductor was about 2.5 mm and its length was about 15 mm, with the thickness of the annular wall being about 6 mm (11 mm in its thicker portion). All of the above dimensions were calculated as a function of the insulating material used for making the insulating elements of the coil and as a function of the various voltages that may arise within the coil. The dielectric strength of the insulating material was about 14 kV/mm, and the potential differences that may exist could be up to 16 kV. Dimensioning was performed for a potential difference of twice the nominal value.

A first advantage of the present invention lies in the possibility, for given coil energy, of reducing the number of turns per coil and thus of reducing the operating voltage. It is known that operating voltage is an increasing function of coil inductance, with inductance varying with the square of number of turns.

Another advantage of the present invention results from the possibility of making coils of short axial length. This makes it possible to have more coils per meter of barrel and thus to provide better control over the load-propelling signal.

These advantages result in particular from the special shape of the former which makes it possible to hold the conductors in place at locations where the electromotive reaction forces are greatest, and to avoid having any bonding between two windings in the vicinity of a zone of great heating due to eddy currents in the coil, and also to make it possible to use two windings of the transposed type thus enabling current to be distributed in balanced manner within each conductor.

Naturally, the invention is not limited to the embodiment described and shown, but is capable of numerous variants that are accessible to the person skilled in the art without going beyond the invention.

I claim:

1. A coil comprising a hollow former on which a coil is made comprising a plurality of conductors of the same length, together with connection means between the conductors and an electrical power supply for the coil, wherein the conductors are insulated, mutually parallel, and wound together on said former, each conductor being angularly offset relative to the other conductors, and forming spiral turns that are stacked and interleaved with the spiral turns of the other conductors, said conductors forming first and second windings on a common winding axis, one of the free ends of each conductor being accessible at the outer periphery of the first winding, while the other free end of the same conductor is accessible on the outer periphery of the second winding.

2. A coil according to claim 1, wherein, for each conductor the crossover between the two windings is located on the former.

3. A coil according to claim 1, wherein the cross-section of the conductors is substantially rectangular.

4. A coil according to claim 1, wherein the former is a circular hollow cylinder having the same axis as the winding axis, comprising two same-axis and same-diameter integral touching rings, each ring being designed to support one of the two windings, each ring having an outer face provided with the same number of peripheral ramps as there are conductors so as to enable the conductors in the same winding to be offset and superposed, the peripheral ramps of one ring all pointing in one direction of rotation about the axis of the former and the peripheral ramps of the other ring all pointing in the opposite direction of rotation about the axis of the former, each peripheral ramp of one ring pointing in one direction being substantially adjacent to a peripheral ramp of the other ring pointed in the opposite direction, a groove being formed between the tops of the substantially adjacent opposing peripheral ramps so as to allow a conductor to cross over from one winding to the other winding.

5. A coil according to claim 4, wherein the ramps are distributed at equal distances over the outer faces, each ramp having a high face concentric with the outer face of the ring, and a slope to pass from the outer face to the high face, each ramp of a given ring being separated from the next by a length of the outer face.

6. A coil according to claim 4, wherein the former also has intermediate elements located at the intersection between the two rings and subdividing each length of the outer face of a ring from the facing length of the outer face of the other ring, said intermediate elements being of a height equal to the height of the high faces of the ramps, and having at least one substantially curvilinear radial wall.

7. A coil according to claim 4, wherein the depth of the grooves is substantially equal to the thickness of the conductors, and the width of the grooves is substantially equal to the width of the conductors.

8. A coil according to claim 4, including a winding-separating radial annular wall centered on the axis of the former and located between the first and second windings, said wall having an inside radius that is substantially equal to the radius of the high faces of the ramps.

9. A coil according to claim 8, wherein a winding-separating radial annular wall is disposed concentrically with and in contact with intermediate elements.

10. A coil according to claim 1, wherein the former is machined out of insulating material having high dielectric strength.

11. A coil according to claim 1, wherein the connection means between the conductors and the power supply of the coil are disposed radially on the outer periphery of the coil, each including an electrical connection between a respective end of the conductor and the power supply of the coil.

12. A coil according to claim 11, wherein each connection comprises a piece of metal foil connected to each end of each conductor of each winding, said pieces of metal foil each having a conductor connection end, a radial portion, and a free end connected to a connection box enabling the metal foil to be connected to a power supply cable, itself connected to the power supply of the coil, the power supply cable reaching the coil tangentially.

13. A coil according to claim 12, wherein an electrically insulating band is formed on each winding surrounding the conductor connection ends of the pieces of metal foil.

14. A coil according to claim 12, wherein each winding is surrounded by an electrically insulating collar, the radial annular insulating wall extending from the outer periphery of the collars and having radial grooves for receiving the radial portions of the pieces of metal foil.

15. A coil according to claim 14, wherein the radial annular insulating wall between the outer periphery of the windings and the outer periphery of the insulating collars presents greater thickness within which said radial grooves for receiving the radial portions of the pieces of metal foil are formed.

16. A coil according to claim 12, wherein, for each conductor the two power supply cables are coaxial, and the two connection boxes are disposed one behind the other, with the free ends of the pieces of metal foil mounted on one of the free ends of the conductor being connected to a first connection box connected to the outer power supply cable of a coaxial cable, and with the inner cable passing through said first connection box in electrically insulated manner, the free end of the piece of metal foil mounted on the other free end of the conductor being connected to a second connection box disposed ahead of the first box and connected to the inner power supply cable of the coaxial cable.

17. A coil according to claim 1, including two axial end insulating plates.

* * * * *